US012649611B2

(12) United States Patent
Hu

(10) Patent No.: US 12,649,611 B2
(45) Date of Patent: Jun. 9, 2026

(54) FOLDING DETERGENT CONTAINER

(71) Applicant: CIRCL, INC., Hayward, CA (US)

(72) Inventor: Chris Hui Chuan Hu, New Taipei City (TW)

( * ) Notice: Subject to any disclaimer, the term of this patent is extended or adjusted under 35 U.S.C. 154(b) by 199 days.

(21) Appl. No.: 18/434,961

(22) Filed: Feb. 7, 2024

(65) Prior Publication Data

US 2025/0250072 A1 Aug. 7, 2025

(51) Int. Cl.
*B65D 47/06* (2006.01)
*B65D 37/00* (2006.01)
*B65D 21/02* (2006.01)

(52) U.S. Cl.
CPC ..... *B65D 47/063* (2013.01); *B65D 37/00* (2013.01); *B65D 21/0233* (2013.01)

(58) Field of Classification Search
CPC .. B65D 47/063; B65D 1/0284; B65D 1/0292; B65D 21/086; B65D 47/046; B65D 47/10
USPC ..... 220/666; 222/92
See application file for complete search history.

(56) References Cited

U.S. PATENT DOCUMENTS

2015/0251795 A1* 9/2015 Tsui ..... B65D 1/0292 215/379
2018/0194517 A1* 7/2018 Brooks ..... B65D 81/3865

* cited by examiner

*Primary Examiner* — Stephen J Castellano

(57) ABSTRACT

A folding detergent container includes a reservoir including a dispensing part on a top, an intermediate folding part, and a bottom edge part. The reservoir is stepped and tapered from bottom to top. A middle of the dispensing part is provided with a reclosable opening. The reclosable opening is covered by a folding plate. A lever is formed with and projects upward from the folding plate. An edge of the dispensing part is provided with a baffle having an arc section. The folding part includes a plurality of folding lines and a plurality of folding sections. Thickness of the folding section is greater than that of the folding line so that the folding part is configured to axially fold. The folding sections are alternated with the folding lines, and the folding section is provided between the two adjacent folding lines. A protective film attached to the bottom edge part.

6 Claims, 8 Drawing Sheets

FOLDING DETERGENT CONTAINER

FIELD OF THE INVENTION

The invention relates to containers and more particularly to a folding detergent container having improved characteristics.

BACKGROUND OF THE INVENTION

Conventionally, a bottle is filled with a detergent. The top of the bottle is provided with a screw cap closure. The detergent is poured out of an opening of the bottle for cleaning applications. However, weight of the conventional bottle is relatively heavy, making it cumbersome during consumer use and transportation. Further, its transportation cost is relatively high. After use, the bulky empty container can be inconvenient to recycle, and the closure is even less likely to be recycled. Therefore, the conventional package is not considered environmentally friendly.

Thus, the need for improvement still exists.

SUMMARY OF THE INVENTION

It is therefore one object of the invention to provide a folding detergent container, comprising a reservoir including a dispensing part, a folding part, a bottom edge part, and a protective film attached to the bottom edge part; wherein the dispensing part is provided on a top of the reservoir, a diameter of the dispensing part is less than each of a diameter of the folding part and a diameter of the bottom edge part so that the reservoir is stepped and tapered from bottom to top, a middle of the dispensing part is provided with a reclosable opening, the reclosable opening is covered by a folding plate, a lever is formed with and projects upward from the folding plate, an edge of the dispensing part is provided with a baffle having an arc section, and the folding part is provided between the dispensing part and the bottom edge part; wherein the folding part includes a plurality of folding lines and a plurality of folding sections, thickness of the folding section is greater than that of the folding line so that the folding part is configured to axially fold, the folding sections are alternated with the folding lines, and the folding section is provided between the two adjacent folding lines; wherein the bottom edge part is provided on a bottom of the reservoir.

Preferably, each of the folding lines include a first folding part and a second folding part; each of the folding sections includes a first folding element and a second folding element; the first folding element is a vertical surface and the second folding element is a truncated conic surface; the first folding element is alternated with the second folding element; the first folding part is provided at a joining portion of a lower edge of the first folding element and an upper edge of the second folding element; thickness of each of the first folding element and the second folding element is greater than that of the first folding part; the second folding part is provided at a joining portion of an upper edge of the first folding element and a lower edge of the second folding element; and thickness of each of the first folding element and the second folding element is greater than that of the second folding part.

The invention has the following advantages and benefits in comparison with the conventional art:

Reduced storage space and easy recycling: once the container is emptied, a user may axially press and collapse the folding part. It is noted that the first folding element is a vertical surface, the second folding element is a truncated conic surface, thickness of the folding section is greater than that of the folding line, and a flexible deformation of the second folding part is greater than that of the first folding part. Thus, the second folding elements may be pressed into the first folding elements by means of the first folding parts and the second folding parts. As a result, the folding part is substantially flat and the reservoir is collapsed to have a minimum volume, i.e., saving storage space for ease of return transportation to recycling facility.

Light weight and reduced transportation cost: the detergent container is made of relatively thin and recyclable materials. The reservoir comprises the dispensing part, the folding part, and the bottom edge part formed integrally. Therefore, the detergent container has advantages including compactness, lightweight, and being easy to carry. The purpose of reducing transportation cost is greatly achieved.

The above and other objects, features and advantages of the invention will become apparent from the following detailed description taken with the accompanying drawings

DETAILED DESCRIPTION OF THE INVENTION

Figure 1:
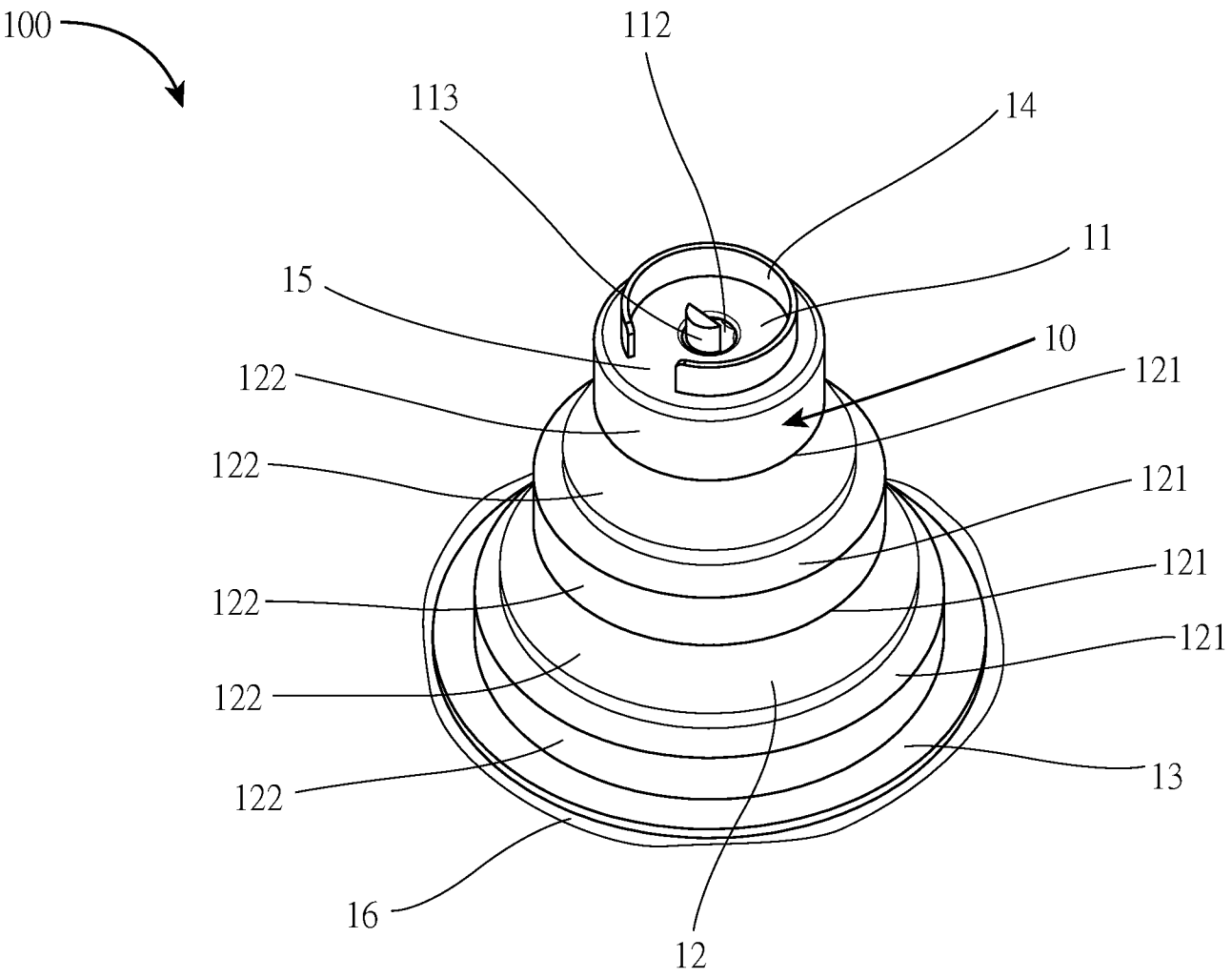
FIG. 1 is a perspective view of a folding detergent container of the invention.
Figure 2:
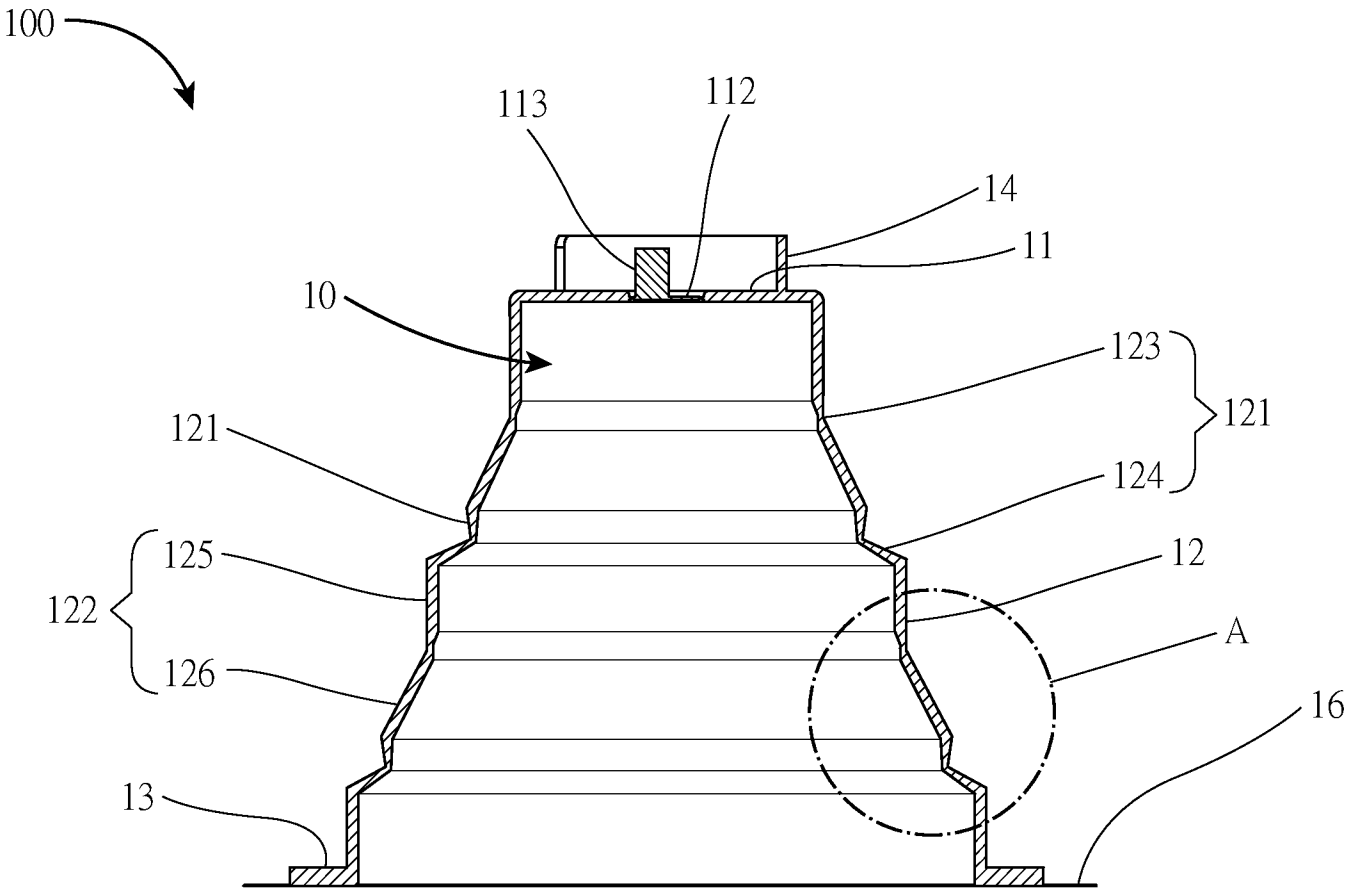
FIG. 2 is a longitudinal sectional view of the folding detergent container.
Figure 3:
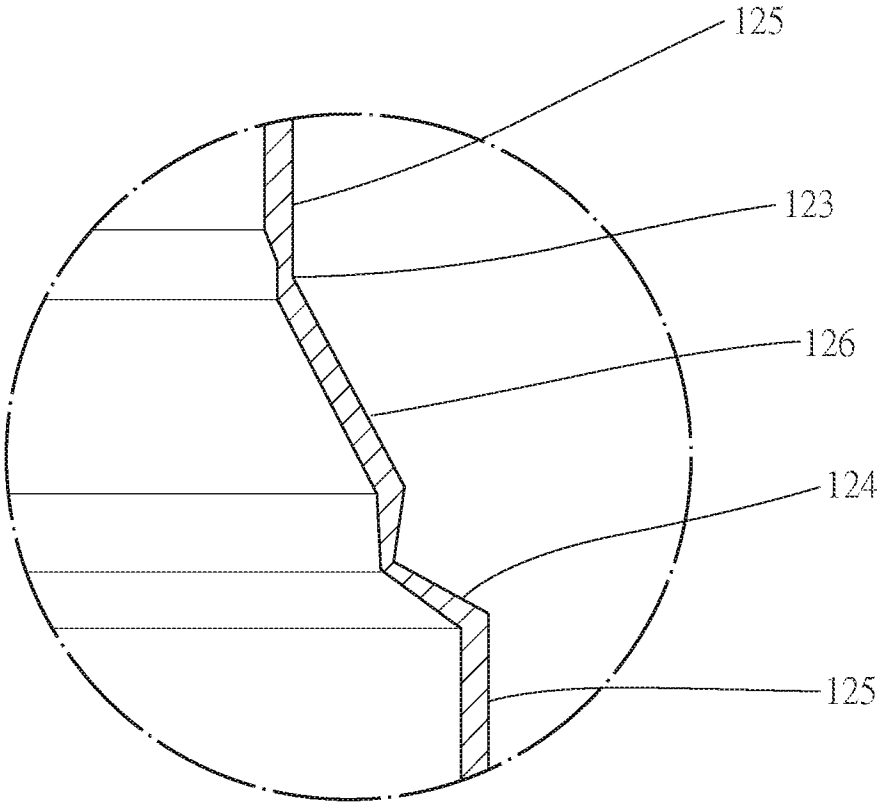
FIG. 3 is a detailed view of the area in a circle A of FIG. 2.
Figure 4:
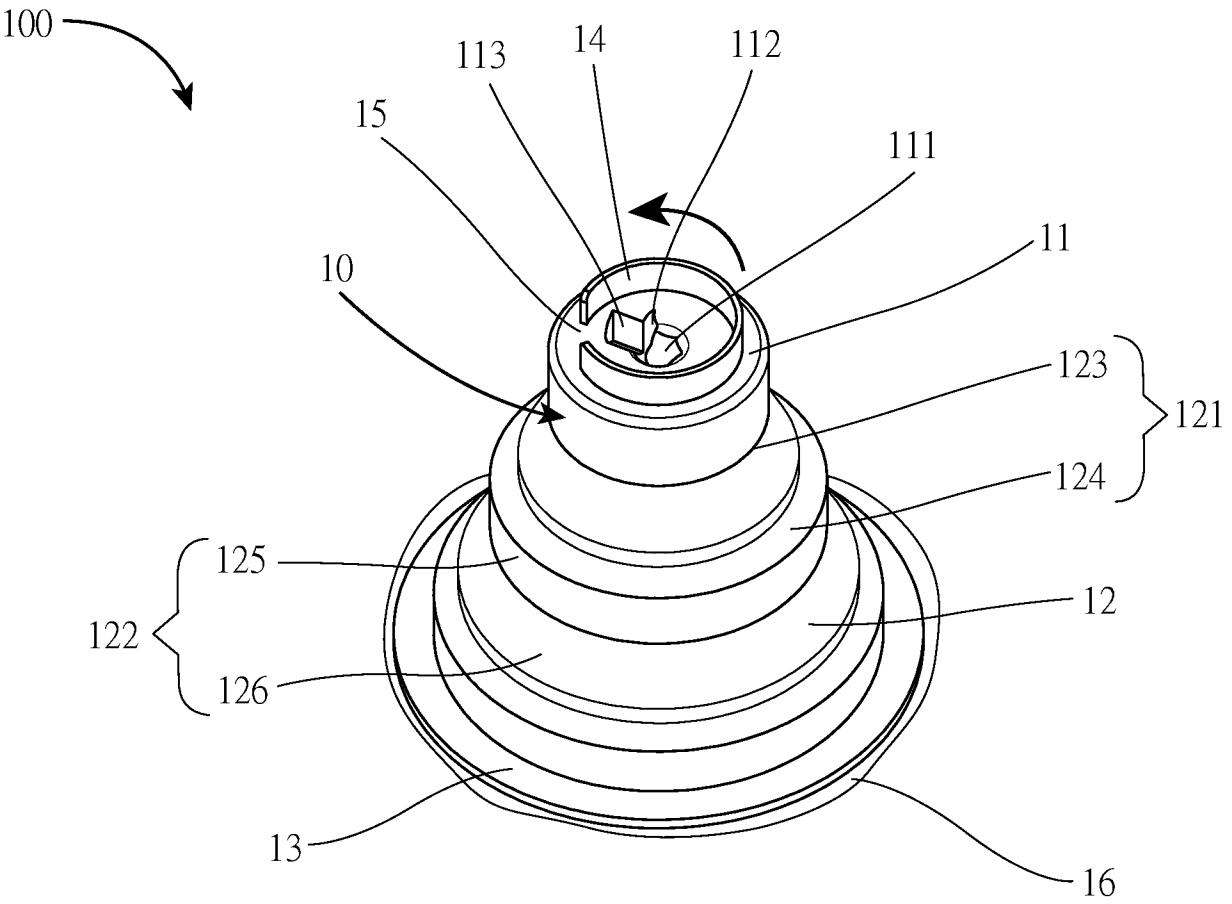
FIG. 4 is a view similar to FIG. 1 showing a reclosable opening being open.

Referring to FIGS. 1 and 4, a folding detergent container 100 according to the invention comprises the following components as discussed in detail below.

A reservoir 10 is made of relatively thin and recyclable material. The reservoir 10 is filled with a detergent. The reservoir 10 comprises a dispensing part 11, a folding part 12, and a bottom edge part 13. A diameter of the dispensing part 11 is less than each of a diameter of the folding part 12 and a diameter of the bottom edge part 13 so that the reservoir 10 is stepped and tapered from bottom to top. The dispensing part 11 is provided on a top of the reservoir 10. The middle of the dispensing part 11 is provided with a reclosable opening 111. The reclosable opening 111 is covered by a folding plate 112 which is frangible. A lever 113 is formed with and projects upward from the folding plate 112. An edge of the dispensing part 11 is provided with a baffle 14 having a notch 15 so that the baffle 14 has an arc section. The baffle 14 and the reclosable opening 111 are spaced by an appropriate distance. In the invention, a height of the baffle 14 is greater than that of the lever 113 to protect the lever 113. The folding part 12 is provided between the dispensing part 11 and the bottom edge part 13. The folding part 12 includes a plurality of folding lines 121 and a plurality of folding sections 122. Thickness of the folding section 122 is greater than that of the folding line 121 so that the folding part 12 may be axially folded when the detergent container 100 is emptied to be subsequently collapsed. The folding sections 122 are alternated with the folding lines 121. That is, the folding section 122 is provided between the two adjacent folding lines 121. The folding line 121 includes a first folding part 123 and a second folding part 124. The folding section 122 includes a first folding element 125 and a second folding element 126. The first folding element 125 is a vertical surface and the second folding element 126 is a truncated conic surface. The first folding element 125 is alternated with the second folding element 126. The first folding part 123 is provided at a joining portion of a lower edge of the first folding element 125 and an upper edge of the second folding element 126. Thickness of each of the first folding element 125 and the second folding element 126 is greater than that of the first folding part 123. The second folding part 124 is provided at a joining portion of an upper edge of the first folding element 125 and a lower edge of the second folding element 126. Thickness of each of the first folding element 125 and the second folding element 126 is greater than that of the second folding part 124. Further, the bottom edge part 13 is provided on a bottom of the reservoir 10 and the bottom edge part 13 is provided with a protective film 16.

Figure 5:
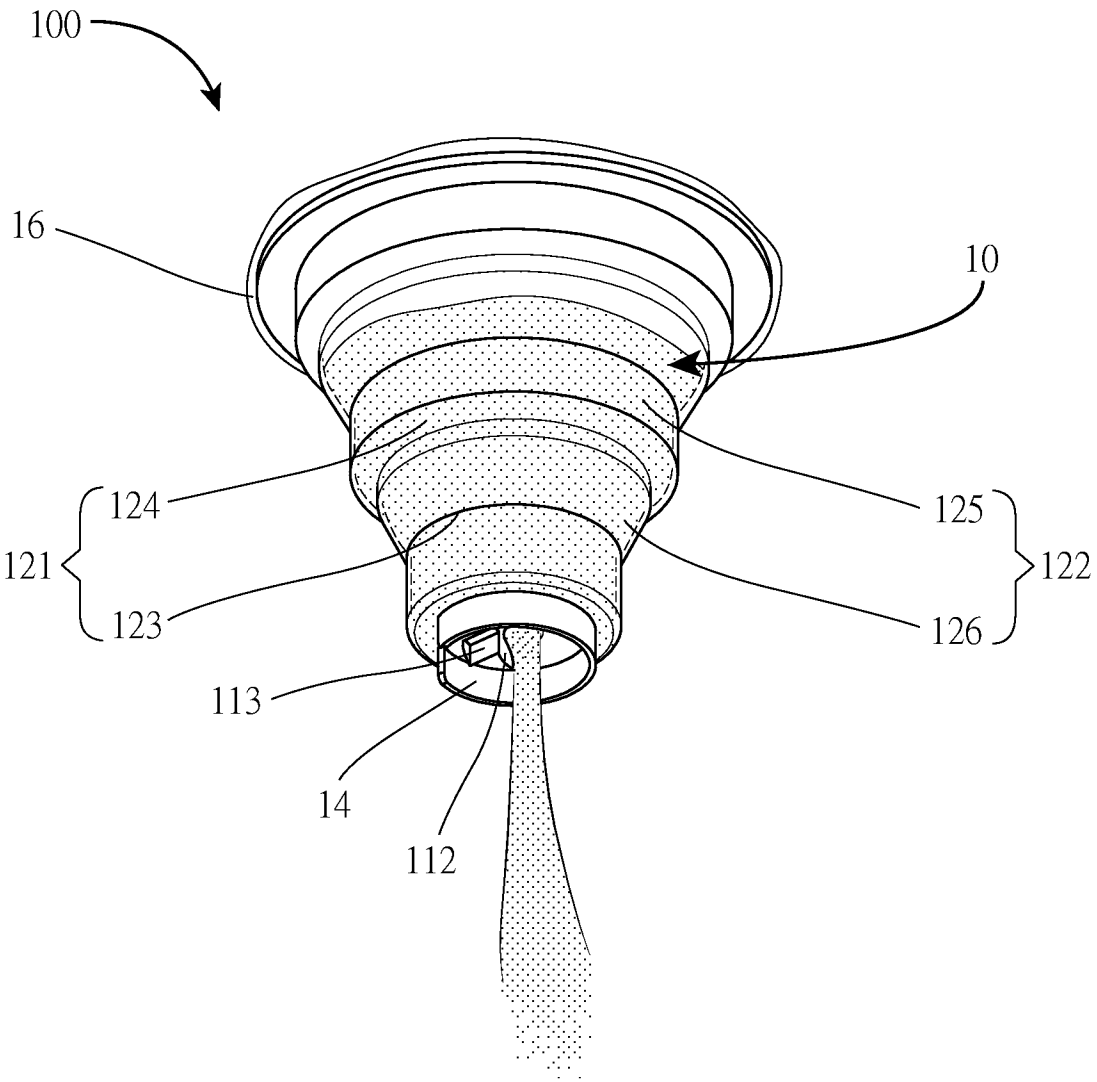
FIG. 5 is a perspective view of the inverted detergent container showing detergent flowing out of the reclosable opening.

Referring to FIG. 5 in conjunction with FIG. 4, when the invention is used, a user may pull or push the lever 113 toward the notch 15. As such, the folding plate 112 pivots to open the reclosable opening 111. Thus, when the detergent container 100 is inverted, the detergent in the reservoir 10 can flow out of the reclosable opening 111 for use in cleaning applications.

Figure 6:
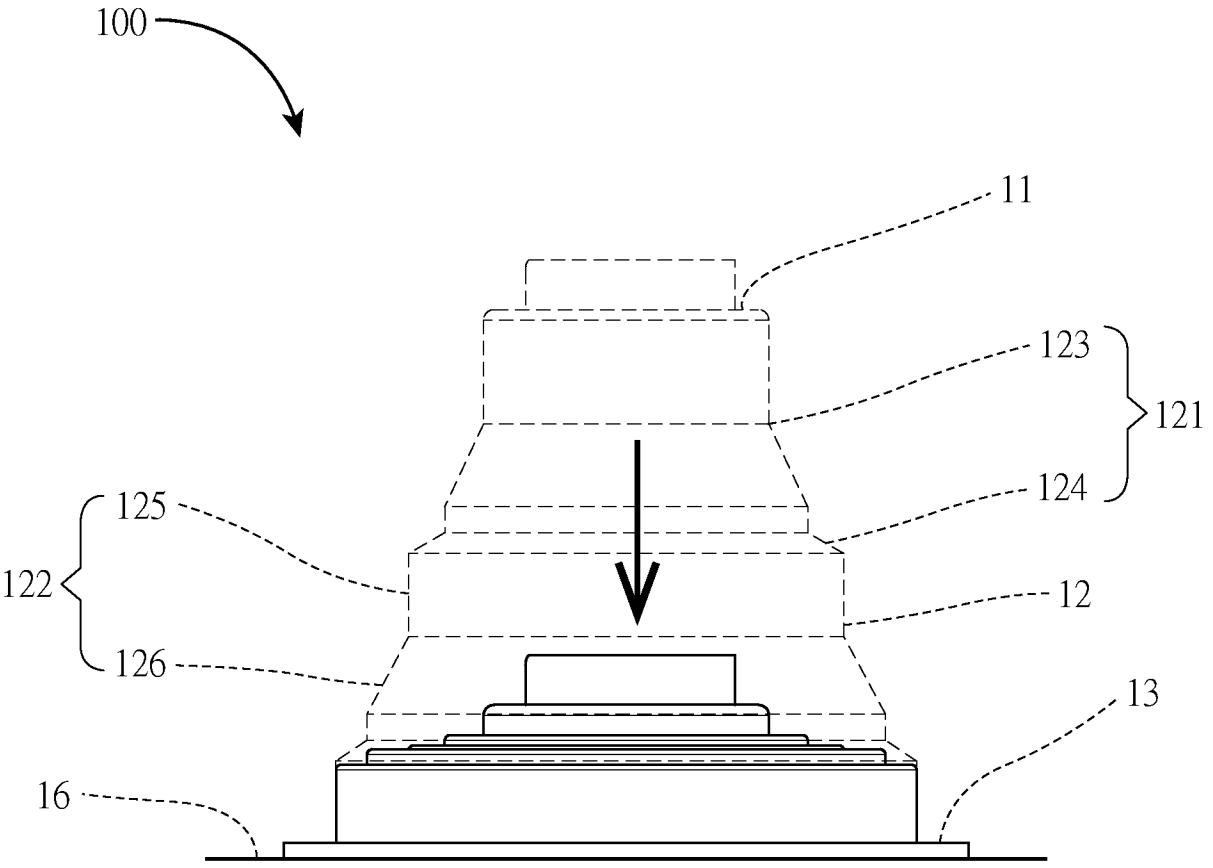
FIG. 6 is a side elevation schematically showing the folded detergent container which is collapsed.
Figure 7:
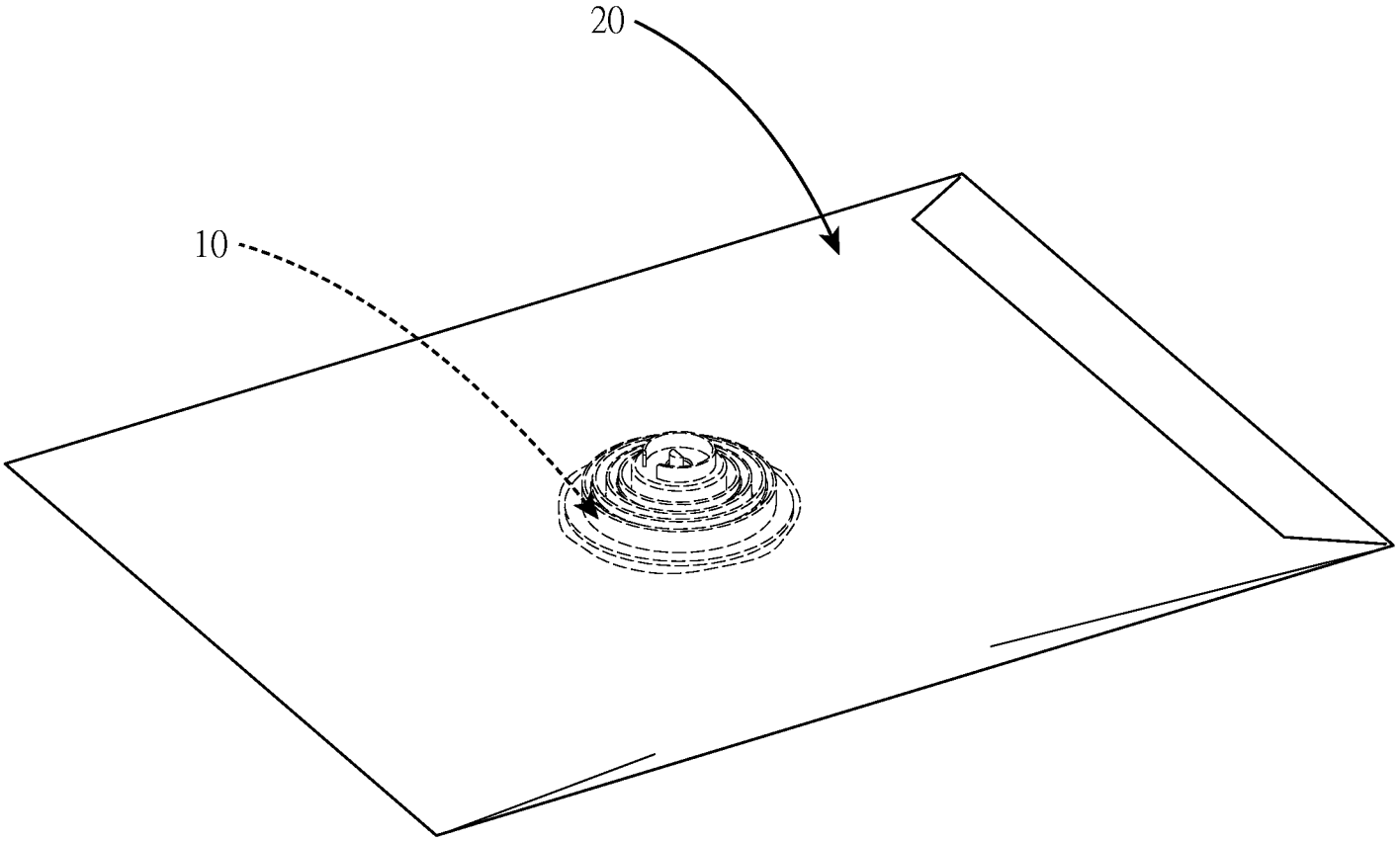
FIG. 7 schematically shows the detergent container placed in an envelope.

Referring to FIGS. 6 and 7 in conjunction with FIG. 4, after use, the lever 113 may be pushed away from the notch 15 to push down the folding plate 112 to close the reclosable opening 111 again. Next, the user may axially press the folding part 12 in order to collapse the detergent container 100 which is emptied. It is noted that the first folding element 125 is a vertical surface, the second folding element 126 is a truncated conic surface, thickness of the folding section 122 is greater than that of the folding line 121, and the thickness of each of the first folding element 125 and the second folding element 126 is greater than that of each of the first folding part 123 and the second folding part 124. Thus, the second folding elements 126 may be pressed into the first folding elements 125 by means of the first folding parts 123 and the second folding parts 124. As a result, the folding part 12 is substantially flat and the reservoir 10 is emptily collapsed to have a minimum volume, i.e., saving storage space for efficient transportation to recycling. Alternatively, the reservoir 10 may be placed in an envelope 20 for ease of storage.

It is worth mentioning that the detergent container 100 is made of relatively thin and recyclable materials. Further, the detergent container 100 is collapsible and integrally-formed. The reservoir 10 comprises the dispensing part 11, the folding part 12, and the bottom edge part 13 formed integrally. Therefore, the detergent container 100 has advantages including compactness, light weight, and being efficient to transport.

Figure 8:
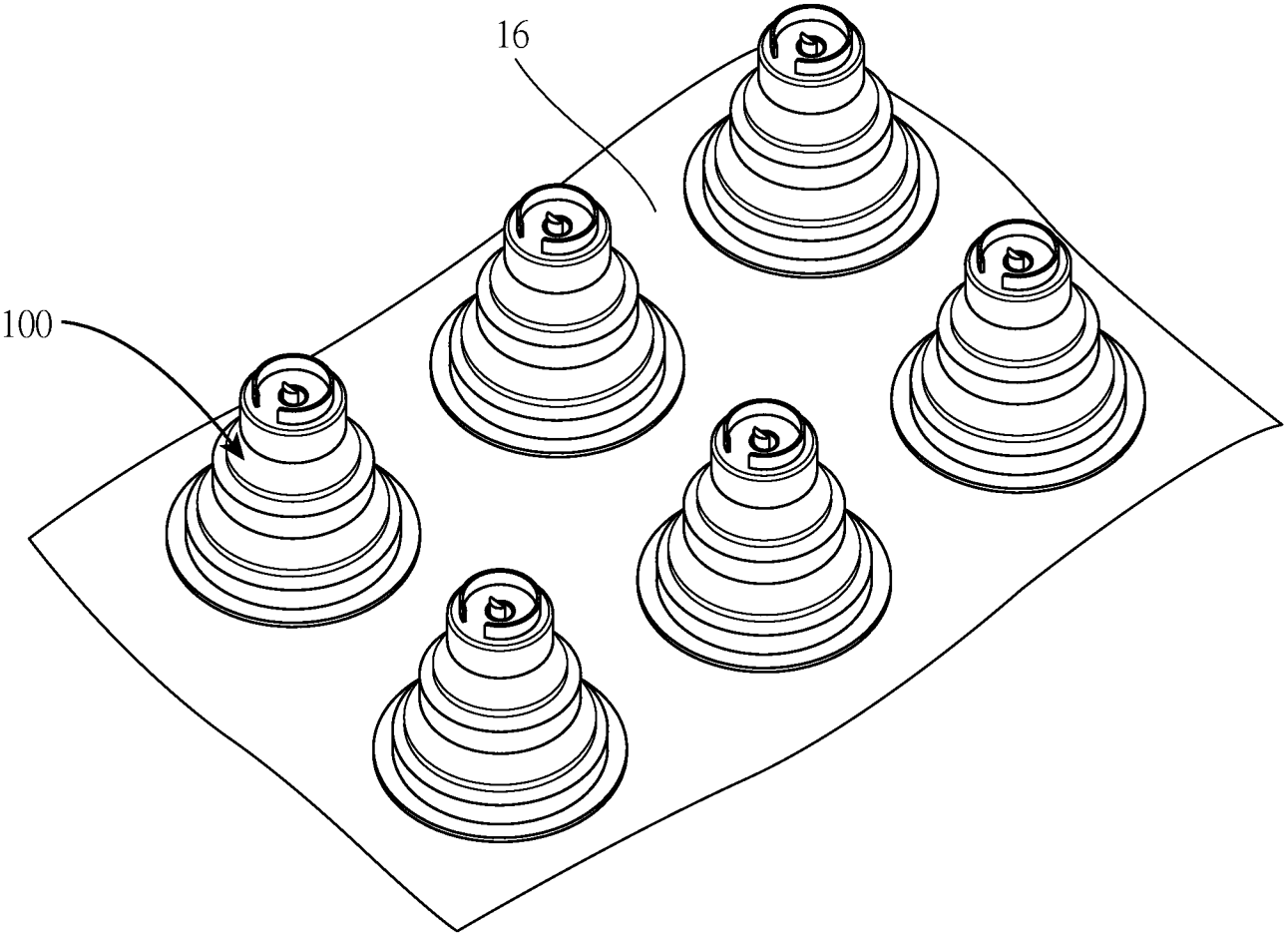
FIG. 8 is a perspective view showing a plurality of the detergent containers with a protective film sealed to bottoms of the detergent containers.

Referring to FIG. 8, the user can carry a plurality of detergent containers 100 at the same time without the need to carry a conventional large detergent container. In turn, the purpose of reducing transportation cost from factory to consumer can be achieved as well as increasing convenience for consumers in terms of transportation and storage.

It is envisaged by the invention that the reservoir 10 is nestable so that the dispensing part 11 of the reservoir 10 fits within the bottom edge part 13 of another reservoir 10, enabling efficient bulk shipping of empty containers to a filling location, further enhancing overall the containers efficiency.

While the invention has been described in terms of preferred embodiments, those skilled in the art will recognize that the invention can be practiced with modifications within the spirit and scope of the appended claims.

What is claimed is:

1. A folding detergent container, comprising:

a reservoir including a dispensing part, a folding part, a bottom edge part, and a protective film attached to the bottom edge part;

wherein the dispensing part is provided on a top of the reservoir, a diameter of the dispensing part is less than each of a diameter of the folding part and a diameter of the bottom edge part so that the reservoir is stepped and tapered from bottom to top, a middle of the dispensing part is provided with a reclosable opening, the reclosable opening is covered by a folding plate, a lever is formed with and projects upward from the folding plate, an edge of the dispensing part is provided with a baffle having an arc section, and the folding part is provided between the dispensing part and the bottom edge part;

wherein the folding part includes a plurality of folding lines and a plurality of folding sections, wherein a thickness of each folding section of said plurality of folding sections is greater than that of each folding line of said plurality of folding lines, so that the folding part is configured to axially fold, the folding sections are alternated with the folding lines, and said each folding section is provided between two adjacent folding lines of said plurality of folding lines;

wherein the bottom edge part is provided on a bottom of the reservoir; and wherein a notch is provided through the baffle.

2. A folding detergent container of claim 1, comprising:

a reservoir including a dispensing part, a folding part, a bottom edge part, and a protective film attached to the bottom edge part;

wherein the dispensing part is provided on a top of the reservoir, a diameter of the dispensing part is less than each of a diameter of the folding part and a diameter of the bottom edge part so that the reservoir is stepped and tapered from bottom to top, a middle of the dispensing part is provided with a reclosable opening, the reclosable opening is covered by a folding plate, a lever is formed with and projects upward from the folding plate, an edge of the dispensing part is provided with a baffle having an arc section, and the folding part is provided between the dispensing part and the bottom edge part;

wherein the folding part includes a plurality of folding lines and a plurality of folding sections, wherein a thickness of each folding section of said plurality of folding sections is greater than that of each folding line of said plurality of folding lines, so that the folding part is configured to axially fold, the folding sections are alternated with the folding lines, and said each folding section is provided between two adjacent folding lines of said plurality of folding lines;

wherein the bottom edge part is provided on a bottom of the reservoir; and wherein a height of the baffle is greater than that of the lever.

3. A folding detergent container, comprising:

a reservoir including a dispensing part, a folding part, a bottom edge part, and a protective film attached to the bottom edge part;

wherein the dispensing part is provided on a top of the reservoir, a diameter of the dispensing part is less than each of a diameter of the folding part and a diameter of the bottom edge part so that the reservoir is stepped and tapered from bottom to top, a middle of the dispensing part is provided with a reclosable opening, the reclosable opening is covered by a folding plate, a lever is formed with and projects upward from the folding plate, an edge of the dispensing part is provided with a baffle having an arc section, and the folding part is provided between the dispensing part and the bottom edge part;

wherein the folding part includes a plurality of folding lines and a plurality of folding sections, wherein a thickness of each folding section of said plurality of folding sections is greater than that of each folding line of said plurality of folding lines, so that the folding part is configured to axially fold, wherein the folding sections are alternated with the folding lines, and wherein said each folding section is provided between two adjacent folding lines of said plurality of folding lines;

wherein the bottom edge part is provided on a bottom of the reservoir, and wherein said each folding line includes a first folding part and a second folding part, said each folding section including a first folding element and a second folding element, wherein the first folding element is a vertical surface and the second folding element is a truncated conic surface, the first folding element being alternated with the second folding element, wherein the first folding part is provided at a joining portion of a lower edge of the first folding element and an upper edge of the second folding element, wherein a thickness of each of the first folding element and the second folding element is greater than that of the first folding part, wherein the second folding part is provided at a joining portion of an upper edge of the first folding element and a lower edge of the second folding element, and wherein the thickness of each of the first folding element and the second folding element is greater than that of the second folding part.

4. The folding detergent container of claim 3, wherein the baffle and the reclosable opening are spaced by a predetermined distance.

5. The folding detergent container of claim 3, wherein the reservoir is nestable so that the dispensing part of the reservoir fits within the bottom edge part of another reservoir.

6. The folding detergent container of claim 3, wherein the folding plate is frangible.

* * * * *